US005499589A

United States Patent [19]

Kyuno et al.

[11] Patent Number: 5,499,589

[45] Date of Patent: Mar. 19, 1996

[54] METHOD AND APPARATUS FOR PRODUCING IMAGE DATA TO BE USED BY EMBROIDERY DATA PROCESSING APPARATUS

[75] Inventors: Mitsuyasu Kyuno, Aichi; Masahiro Mizuno, Nagoya; Masao Futamura, Nagoya; Yukiyoshi Muto, Nagoya, all of Japan

[73] Assignee: Brother Kogyo Kabushiki Kaisha, Japan

[21] Appl. No.: 391,170

[22] Filed: Feb. 21, 1995

[30] Foreign Application Priority Data

Feb. 25, 1994 [JP] Japan ..... 6-027734

[51] Int. Cl.[6] ..... D05B 21/00; D05C 5/06

[52] U.S. Cl. ..... 112/102.5; 112/470.04; 112/475.19

[58] Field of Search ..... 112/121.12, 103, 112/121.11, 262.3, 266.1, 78, 2, 453, 457, 102.5, 470.04, 475.19; 364/470

[56] References Cited

U.S. PATENT DOCUMENTS 4,526,116 7/1985 Mannel ..... 112/103

5,095,835 3/1992 Jernigan et al. ..... 112/103 X 5,386,789 2/1995 Futamura et al. ..... 112/121.12

FOREIGN PATENT DOCUMENTS 4-174699 6/1992 Japan .

*Primary Examiner*—Peter Nerbun

*Attorney, Agent, or Firm*—Oliff & Berridge

[57] ABSTRACT

In a method for producing image data, an original image is defined by at least one outline-bounded region having at least one outline and an inside area bounded by the outline. The method includes the steps of reading, from an original having an initial original image including the outline of one or more outline-bounded regions, the initial original image by an image reader, so as to produce initial image data defining one or both of the outline of the region and the inside area of the region. Subsequently, the step of initially processing the initial original image of the original is performed by forming one or more readable images in the inside area of one or more current regions out of the one or more outline-bounded regions. A next step includes reading, by the image reader, the initially processed original image so as to produce initially processed image data defining the initially processed original image. A final step identifies the initially processed region based on a difference of the initial image data and the initially processed image data.

25 Claims, 9 Drawing Sheets

METHOD AND APPARATUS FOR PRODUCING IMAGE DATA TO BE USED BY EMBROIDERY DATA PROCESSING APPARATUS

BACKGROUND OF THE INVENTION

1. Field of the Invention

The present invention relates to a method and an apparatus for producing image data defining an original image comprising one or more outline-bounded regions, that an embroidery data processing apparatus processes, based on the image data, embroidery data to control a sewing machine to form, on a work sheet, an embroidery corresponding to the original image.

2. Related Art Statement

In the field of industrial embroidery sewing machines, there is known an embroidery-data processing apparatus including a microcomputer capable of processing highly accurate embroidery data in a short time. The processing apparatus is provided by a wide-use personal computer which additionally includes an image scanner and a hard-disk drive. The prior apparatus produces, from an original image, embroidery data to form a multiple-color embroidery corresponding to the original image.

Recently, in the field of home-use or domestic embroidery sewing machines, there has been a demand for an embroidery-data processing apparatus which processes embroidery data to form an embroidery corresponding to a user's desirable original image and which costs low and is easy to use. This demand results from various reasons such as the diversification and/or sophistication of favorites of users, or the improvements of performance of embroidery sewing machines. That is, the users are not satisfied with the conventional sewing machines that can only form an embroidery according to embroidery data pre-stored in the machines. In particular, there is a strong demand for a home-use apparatus which processes embroidery data to form a multiple-color embroidery with a plurality of embroidery threads having different colors, respectively.

In the background, non-examined Japanese patent application (JP) laid open under publication No. 4(1992)-174699 discloses an embroidery-data processing apparatus to meet the above-mentioned demand. This apparatus includes (a) a main device having an incorporated microcomputer, a small-sized display, and several operable keys, and (b) an achromatic-image scanner which produces binary bit-map data representing the white or black color of each picture element of an achromatic original image. When the prior apparatus is operated to process embroidery data to form a multiple-color embroidery with color-different threads, the image scanner is used to pick up or read an achromatic original image and produce image data (i.e., binary bit-map data) defining the original image, as follows:

In the case of embroidering, for example, an original "plant" image, A, shown in FIG. 5, the original image A includes five outline-bounded regions, A1, A2, A3, A4, and A5. The region A1 is the center of the flower of the plant; the region A2 is the petal of the flower; the region A3 is the stem of the plant; and the two regions A4 and A5 are the left-hand and right-hand leaves of the plant, respectively. Each of the outline-bounded regions A1 to A5 has one or more outlines and an inside area bounded by the outline(s). Here, it is assumed that a user has his or her intention that different regions indicated at different hatchings in FIG. 5 are embroidered with different threads having different colors, respectively. Specifically described, since the two regions A4 and A5 are indicated at a common hatching, those regions are sewn using a common thread, i.e., in a common color. Each of the remaining regions A1, A2, A3 is illustrated at a hatching different from those for the other regions, and is sewn with a thread having a color different from the other colors. After all, four sorts of threads, i.e., four colors in total are used to produce a multiple-color embroidery corresponding to the achromatic original image A. To this end, the user is required to prepare four part-original sheets, B1, B2, B3, and B4, as shown in FIGS. 9(A), 9(B), 9(C), and 9(D), having four part-original images, A1; A2; A3; A4, A5, to be embroidered in the first to fourth colors, respectively. The achromatic-image scanner is operated to stepwise read each of the four part-original sheets B1 to B4. Each of the part-original sheets B1 to B4 is prepared by drawing, using, e.g., a black-ink pen, a corresponding part-original image A1, A2, A3, and A4, A5 on a white sheet. Each time the image scanner reads each part-original image A1, A2, A3, and A4, A5 from a corresponding part-original sheet B1, B2, B3, and B4, the microcomputer processes a batch of embroidery data to form stitches filling the inside area(s) of the region(s) of each part-original image. In this case, four batches of embroidery data are processed.

More specifically described, first, the user makes a copy of the outline of the region A1, onto an initial white sheet B1, by using an original B having the original image A shown in FIG. 5 and, e.g., a red carbon paper (red color is not readable or detectable by the achromatic image scanner). Then, the inside area of the outline of the region A1 copied on the sheet B1 is colored in with a black-ink pen (black color is readable by the achromatic image scanner). Thus, the first part-original sheet B1 shown in FIG. 9(A) is prepared. In FIG. 9(A) and each of FIGS. 9(B) to 9(D), the colored-in region(s) is/are indicated at a hatching as a matter of convenience. The same steps are made for each of the regions A2 and A3, so that the second and third part-original sheets B2 and B3 shown in FIGS. 9(B) and 9(C) are prepared. Finally, the two regions A4 and A5 to be embroidered in a common color are copied and colored in on the single sheet B4, so that the fourth part-original sheet B4 shown in FIG. 9(D) is obtained.

Generally, the inside area of an outline-bounded region is embroidered by being filled with stitches such as satin stitches, seed stitches, or multiple-pattern stitches. The multiple-pattern sewing is carried out by forming a multiplicity of prescribed patterns (e.g., circles, stars, etc.) in the inside area of an outline-bounded region and thereby filling the region with the thus formed multiple-pattern stitches.

However, the conventional image-data producing method disclosed in JP 4-174699 requires a user to prepare two or more part-original sheets, not only loading the user down with a large amount of work, but also increasing the data production cost, in order to produce embroidery data necessary to form an embroidery corresponding to user's desirable original image. In the prior embroidery-data processing apparatus for the home-use embroidery sewing machines, the achromatic-image scanner is employed for economic and other reasons. If a chromatic-image scanner that can read a full-color original image is employed in place of the achromatic-image scanner, then the chromatic-image scanner itself costs higher, and the processing apparatus needs more complex and larger-sized hardware and software arrangements for processing the full-color image data produced by the chromatic-image scanner. Those high-performance arrangements are more than enough for the home-use apparatus, and cost higher than acceptable.

SUMMARY OF THE INVENTION

It is therefore an object of the present invention to provide a method and an apparatus for easily producing, using an image reader, image data defining an original image comprising one or more outline-bounded regions, so that an embroidery data processing apparatus processes, based on the image data, embroidery data to control a sewing machine to form, on a work sheet, an embroidery corresponding to the original image.

The above object has been achieved by the present invention. According to a first aspect of the present invention, there is provided a method of producing image data defining an original image comprising at least one outline-bounded region having at least one outline and an inside area bounded by the outline, the method comprising the steps of: reading, from an original having an initial original image comprising the outline of the at least one outline-bounded region, the initial original image by an image reader, so as to produce initial image data defining at least one of the outline of the region and the inside area of the region; initially processing the initial original image of the original by forming at least one readable image in the inside area of at least one current region out of the at least one outline-bounded region; reading, by the image reader, the initially processed original image so as to produce initially processed image data defining the initially processed original image; and identifying the initially processed region based on a difference of the initial image data and the initially processed image data.

In the image data producing method arranged as described above, after the image reader is used to read the initial original image comprising the outline of one or more outline-bounded regions, from the original having the initial original image, and produce the initial image data defining (a) the outline of the region and/or (b) the inside area of the region, a user may initially or first time process the initial original image on the original by forming one or more readable images in the inside area of one or more current or first regions out of the one or more outline-bounded regions of the initial original image. Subsequently, after the image reader is used to read the initially processed original image and produce initially processed image data defining the initially processed original image, the initially processed region(s) is/are identified based on a difference of the initial image data and the initially processed image data. Thus, one or more regions simultaneously processed by the user to be embroidered with a common needle thread, i.e., in a common color is/are easily identified. The user is required to first prepare the original having the initial original image comprising the outline(s) of one or more outline-bounded regions, so as to read the initial original image, and then required to process the initial original image on the same original, so as to read the initially processed original image. Therefore, the amount of working of the user to prepare the original is much smaller than the conventional method in which a user is required to prepare many part-original images and sheets for a single original image. The readable image(s) may be an image(s) formed by coloring in one or more regions, or an image(s) formed by drawing a mark(s), such as black circle(s), in the inside area(s) of one or more region(s). The present method may further comprise the step of producing initially processed region-defining data defining the initially processed region, the image data comprising the initially processed region-defining data. The region-defining data may comprise at least one of (a) outline-defining data defining the outline of the initially processed region and (b) area-defining data defining the inside area of the initially processed region.

In a preferred embodiment in accordance with the first aspect of the invention, the step of reading the initial original image comprises reading, from the original having the initial original image comprising the outline of each of a plurality of outline-bounded regions, the initial original image so as to produce the initial image data comprising at least one of (a) outline-defining data defining the outline of the each region and (b) area-defining data defining the inside area of the each region, and wherein the method further comprises at least one repetition of the steps of: further processing the previously processed original image of the original by forming at least one readable image in the inside area of at least one current region out of at least one remaining outline-bounded region which has not been processed yet; reading, by the image reader, the further processed original image so as to produce further processed image data defining the further processed original image; identifying the further processed region based on a difference of the further processed image data and the processed image data defining the previously processed original image; and producing further processed region-defining data defining the further processed region, the image data comprising the further processed region-defining data. Each time the user processes a previously processed original image by forming one or more readable images in the inside area(s) of one or more current regions out of one or more outline-bounded regions not yet processed, the image reader is used to read the further processed original image and produce further processed image data defining the further processed original image. The currently processed region(s), i.e., further processed region(s) is/are identified based on the difference between the further processed image data and the processed image data defining the previously processed original image. By repeating these steps, a number of sets of processed region-defining data are produced. Each set of processed region-defining data may be used to process a batch of embroidery data to form stitches filling a corresponding processed region or regions.

In another embodiment in accordance with the first aspect of the invention, the step of identifying the initially processed region comprises judging that the inside area of the initially processed region is covered with the readable image, when a ratio of an area of the readable image to an area of the inside area of the initially processed region is greater than a reference value. In this case, the user is not required to color in the inside area(s) of one or more region(s) to be processed, in a complete or strict manner, and the user is allowed to erroneously or accidentally color in a small portion of adjacent region not to be processed. Thus, the coloring-in of the region(s) can be carried out with easiness and with efficiency. This judging step may comprise selecting, for each of a plurality of different regions having different areas, a corresponding one of a plurality of different reference values. In the last case, if a small reference value is used for large regions, the user can "color in" a large region by just writing a small readable image having a small area in the inside area of the large region.

In yet another embodiment in accordance with the first aspect of the invention, the step of reading the initial original image comprises reading the initial original image comprising the outline of each of a plurality of outline-bounded regions contiguous with each other, from the original on which the outline of the each region is prepared by a user, so as to produce the initial image data comprising outline-defining data defining the outline of the each region, the outline of the each region including a boundary line at which the regions are contiguous with each other.

In another embodiment in accordance with the first aspect of the invention, the step of processing the initial original image comprises processing the initial original image by forming the readable image with a material selected from the group consisting of a color ink and a color tape. Other color materials readable or detectable by the image reader may be employed. Other color inks or tapes than black may be used.

According to a second aspect of the present invention, there is provided an apparatus for producing image data defining an original image comprising at least one outline-bounded region having at least one outline and an inside area bounded by the outline, the apparatus comprising: an image reader which reads, from an original having an initial original image comprising the outline of the at least one outline-bounded region, the initial original image so as to produce initial image data defining at least one of the outline of the region and the inside area of the region; a first memory which stores the initial image data; the image reader reading an initially processed original image obtained by processing the initial original image of the original by forming at least one readable image in the inside area of at least one current region out of the at least one outline-bounded region, so as to produce initially processed image data defining the initially processed original image; a second memory which stores the initially processed image data; and identifying means for identifying the initially processed region based on a difference of the initial image data stored in the first memory and the initially processed image data stored in the second memory.

The image data producing apparatus constructed as described above enjoys the same advantages as those with the image data producing method in accordance with the first aspect of the invention.

In a preferred embodiment in accordance with the second aspect of the invention, the image reader comprises means for producing the initial image data and the initially processed image data each of which comprises a number of sets of binary data each set of which represents one of two colors one of which corresponds to a background color of the original and the other of which corresponds to a color of the outline of the outline-bounded region and the readable image. In this case, the hardware and software configurations of the present apparatus can be simplified.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

First, by reference to FIGS. 1 to 5 and 6(A) to 6(E), there will be described an embroidery-data processing apparatus 1 to which the present invention is applied. The present apparatus 1 produces or processes embroidery data to control a domestic or home embroidery sewing machine 15 (FIG. 8) to form an embroidery on a work sheet such as a fabric, cloth, or leather. The following description relates to the operation of the apparatus 1 for processing embroidery data to form a color embroidery corresponding to an original "plant" image, A, shown in FIG. 5. The original image A is drawn, using a black-ink pen, on a white sheet, B, to be used as an original.

Figure 5:
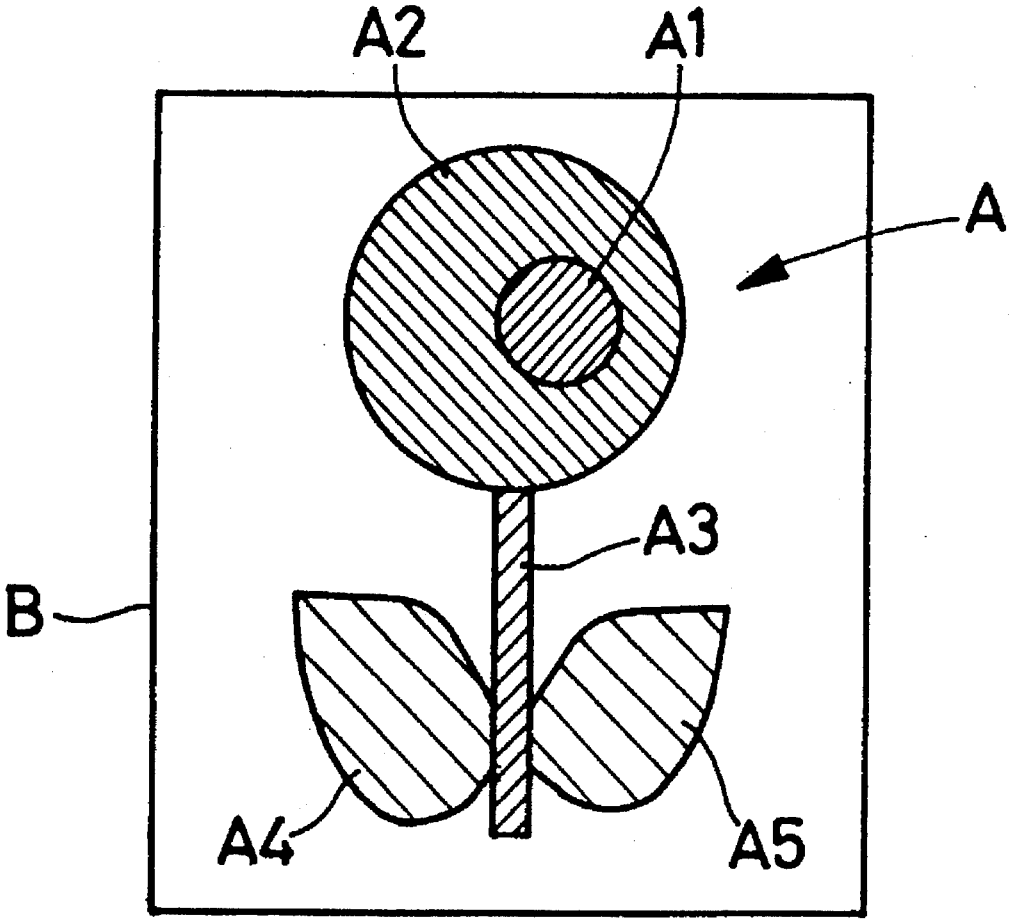
FIG. 5 is a view of an original image, A, which is picked up by an image scanner of the apparatus of FIG. 1 to produce image data defining the original image A.

As shown in FIG. 5, the original "plant" image A includes five outline-bounded regions, A1, A2, A3, A4, and A5. The region A1 is the center of the flower of the plant; the region A2 is the petal of the flower; the region A3 is the stem of the plant; and the regions A4, A5 are the left-hand and right-hand leaves of the plant, respectively. Each of the outline-bounded regions A1 to A5 has one or more outlines and an inside area bounded by the outline(s). For example, the region A1 is bounded by a single outline, whereas the region A2 is bounded by two outlines an inner one of which is also the outline of the region A1. In the following description, it is assumed that different regions indicated at different hatchings in FIG. 5 are embroidered with different needle threads having different colors, respectively. Since the regions A4 and A5 are indicated at a common hatching, those regions are embroidered using a common thread, i.e., in a common color. Since each of the regions A1, A2, A3 is illustrated at a hatching different from those for the other regions and accordingly is embroidered using a needle thread having a color different from the other colors, four sorts of needle threads, i.e., four colors in total are used to produce a multiple-color embroidery corresponding to the original image A.

Figure 1:
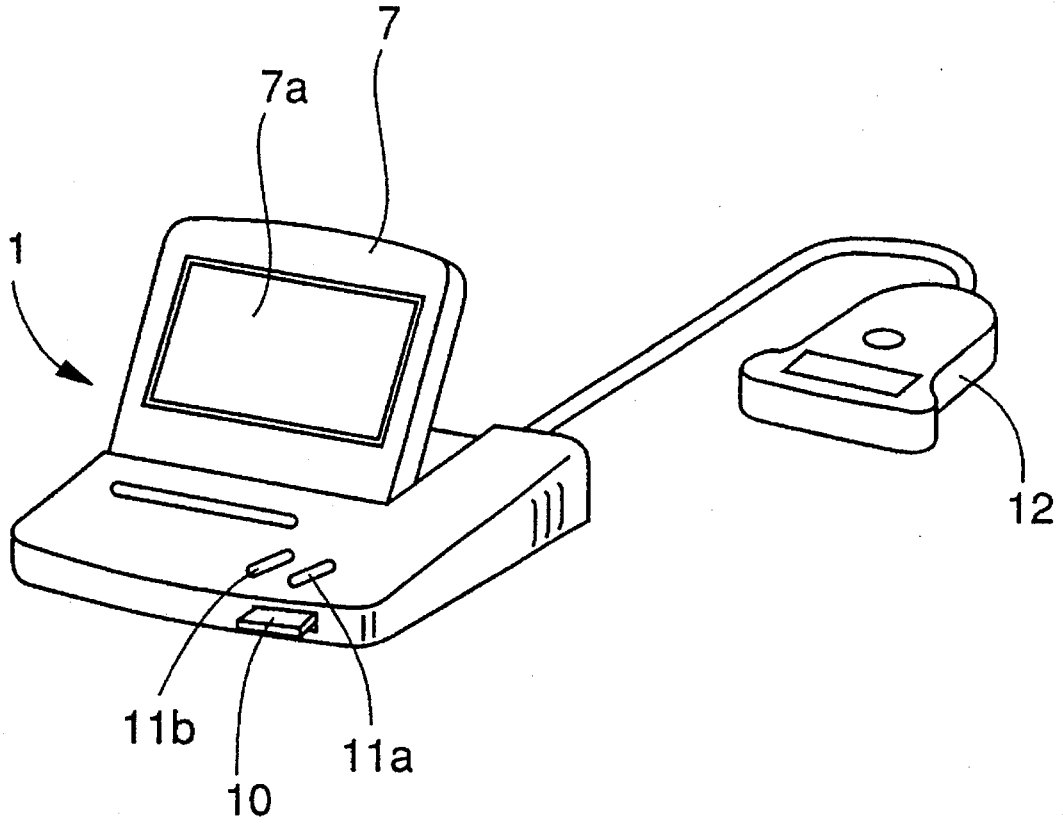
FIG. 1 is a perspective view of an embroidery data processing apparatus to which the present invention is applied.
Figure 8:
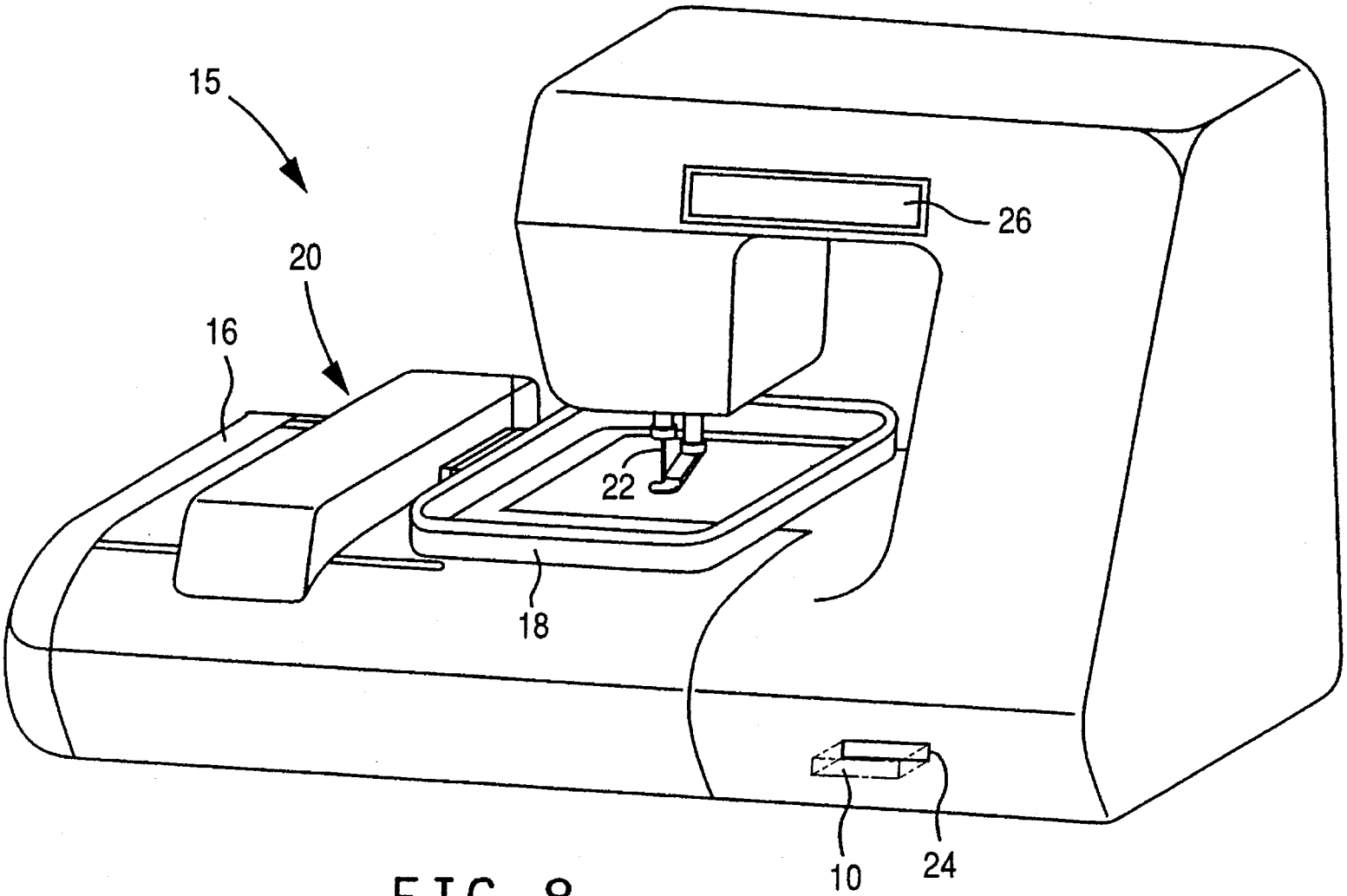
FIG. 8 is a view of a home-use embroidery sewing machine which automatically forms an embroidery on a work sheet by utilizing the embroidery data processed by the apparatus of FIG. 1.
Figure 9A:
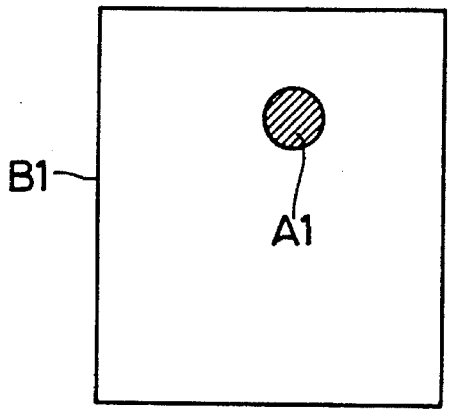
FIG. 9(A) PRIOR ART
FIG. 9(A) is a view of a first part-original sheet prepared in a conventional image-data producing method.
Figure 9B:
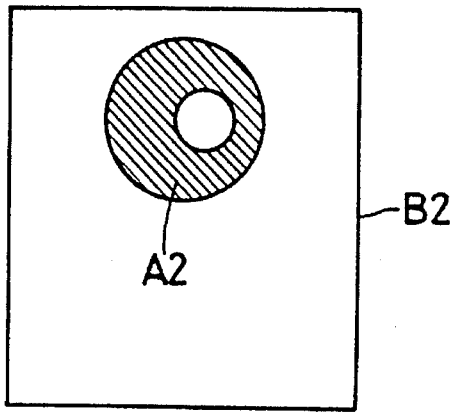
FIG. 9(B) PRIOR ART
FIG. 9(B) is a view of a second part-original sheet prepared in the conventional method.
Figure 9C:
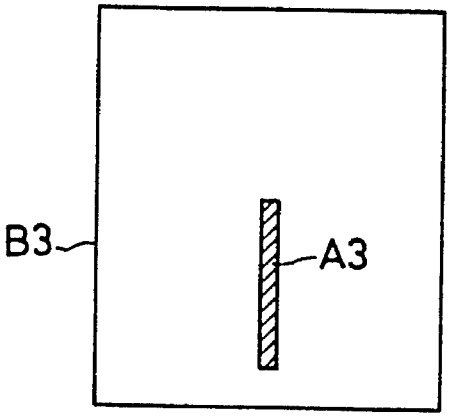
FIG. 9(C) PRIOR ART
FIG. 9(C) is a view of a third part-original sheet prepared in the conventional method.
Figure 9D:
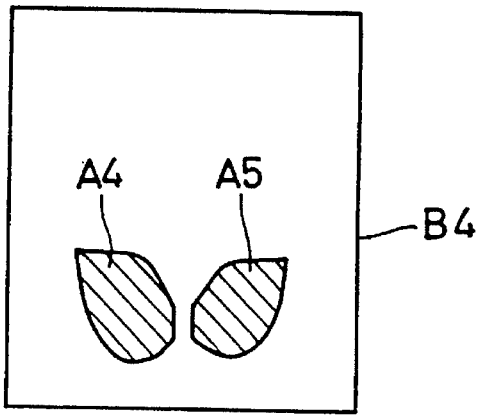
FIG. 9(D) PRIOR ART
FIG. 9(D) is a view of a fourth part-original sheet prepared in the conventional method.

FIG. 8 shows the home embroidery sewing machine 15 which forms the color embroidery corresponding to the original image A, according to the embroidery data processed by the apparatus 1 of FIG. 1. The sewing machine 15 includes a bed 16; a frame 18 for supporting a work sheet; an X-Y feed mechanism 20 for displacing the frame 18 or the work sheet to any position in a horizontal plane defined by the X-Y coordinate system prescribed for the sewing machine 15; a sewing needle 22 for conveying a color embroidery thread (not shown) that is changeable with a different needle thread having a different color, by a user; a loop catcher (not shown) disposed under the bed 16 for catching a loop of the thread conveyed by the needle 22; a drive mechanism (not shown) for vertically reciprocating the needle 22, and rotating the loop catcher, in synchronism with each other; and a control device (not shown) which includes a microcomputer and operates for controlling the feed and drive mechanisms to form the color embroidery corresponding to the original image A, on the work sheet, according to the embroidery data processed by the apparatus 1 of FIG. 1.

The embroidery data processed by the apparatus 1 include sets of stitch-position data (e.g., X and Y coordinate data) which represent respective stitch positions where the sewing needle 22 penetrates the work sheet to form corresponding stitches. Each set of stitch-position data represents respective amounts of movement of the work sheet or the embroidery frame 18 along the X and Y axes to form a corresponding stitch.

As shown in FIG. 8, the sewing machine 15 has a data reading device 24 for reading embroidery data from a flash-memory card 10. A flash memory is an EEPROM (electrically erasable and programmable read only memory). The present apparatus 1 processes embroidery data and stores or records the processed embroidery data in the flash-memory card 10. Alternatively, the apparatus 1 may directly be connected via a data cable to the sewing machine 15, so that the embroidery data produced by the apparatus 1 can directly be transferred to the control device of the sewing machine 15. Otherwise, the apparatus 1 as a whole may be incorporated into the sewing machine 15 of FIG. 8.

The sewing machine 15 has a display device 26 for displaying various messages directed to the user, for example, a message requesting the user to change the current needle thread with a new thread having a different color from that of the current thread.

Figure 2:
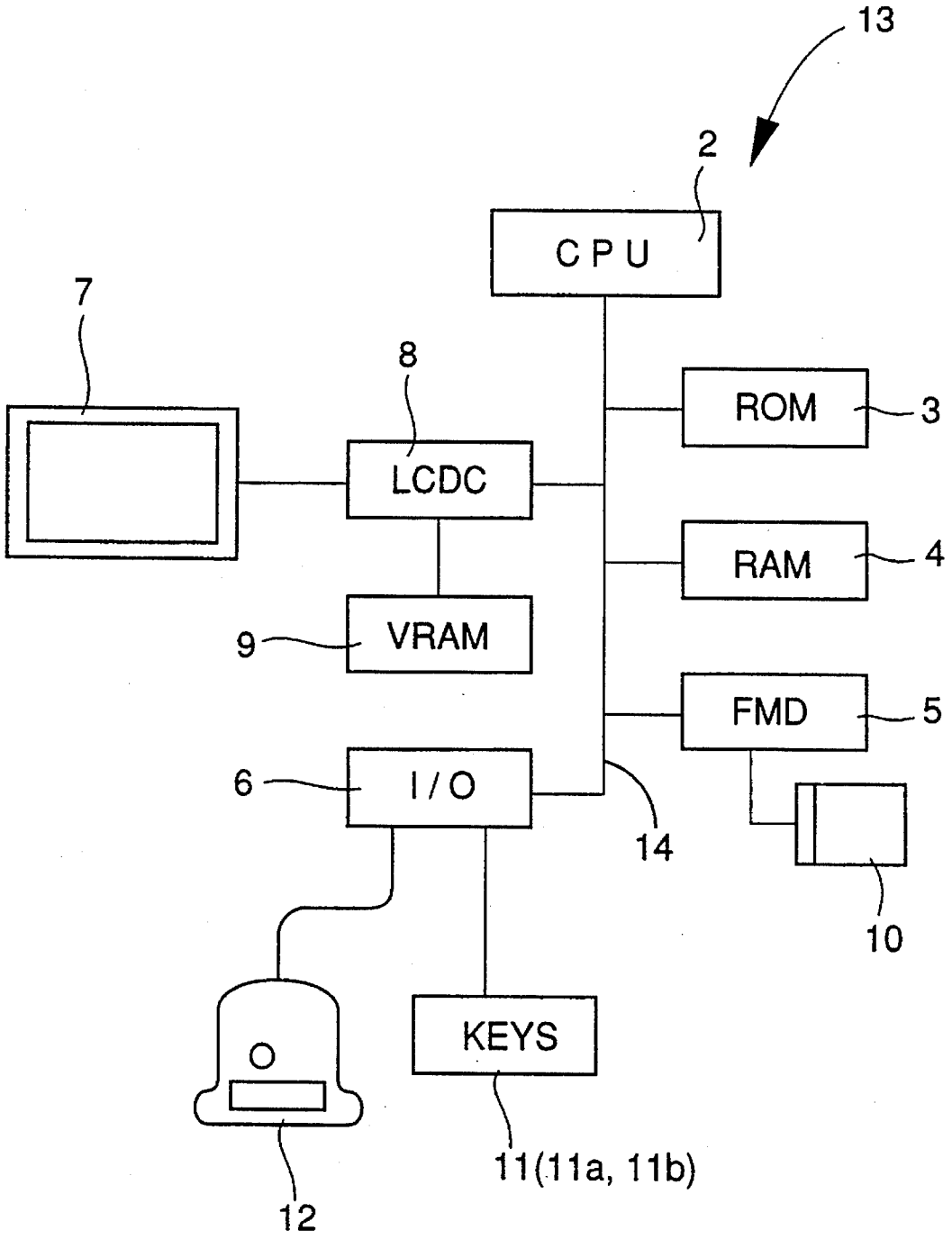
FIG. 2 is a diagrammatic view of the electric arrangement of the apparatus of FIG. 1.
Figure 4:
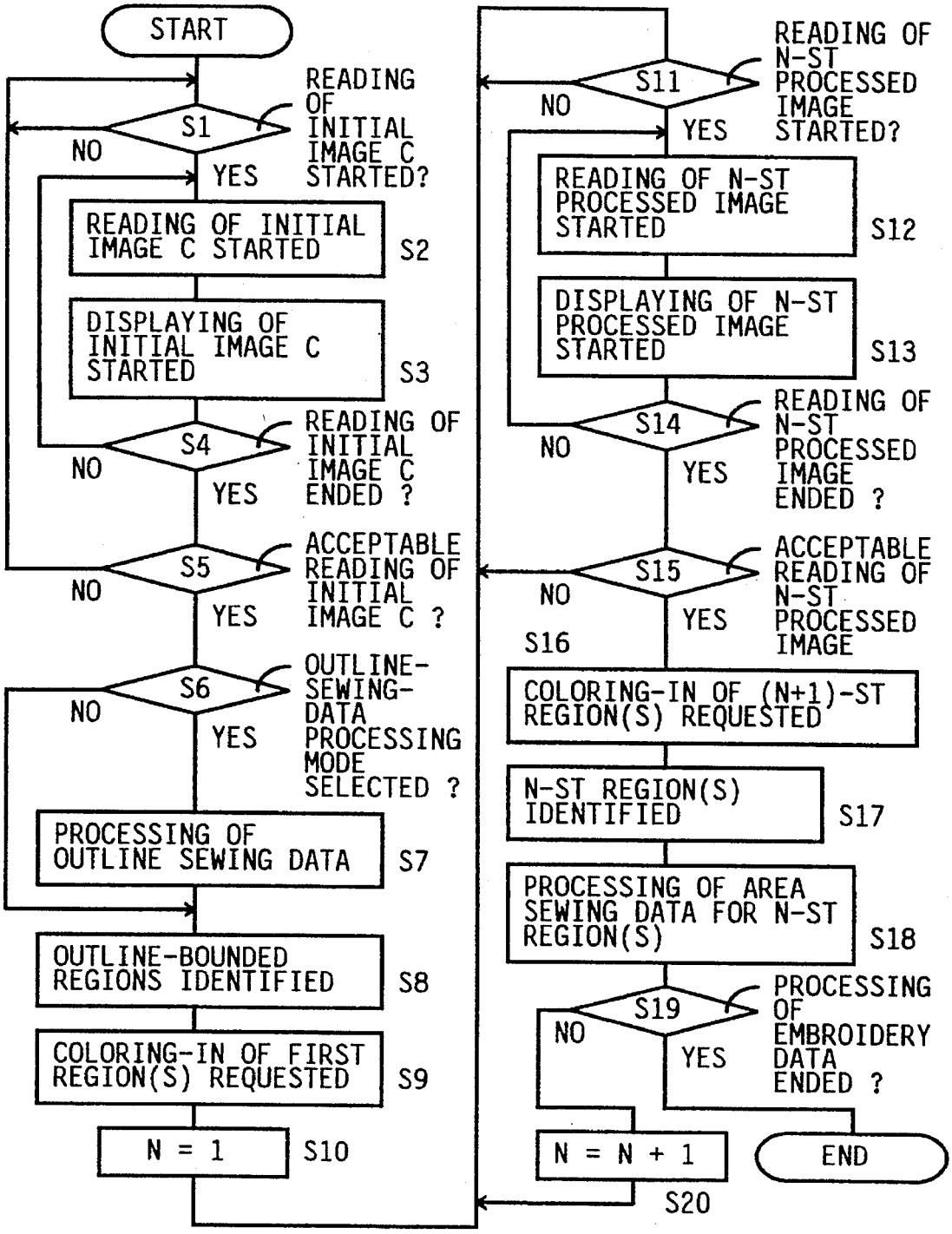
FIG. 4 is a flow chart representing a control program according to which the apparatus of FIG. 1 operates for processing embroidery data.

Next, the electric arrangement of the embroidery data processing apparatus 1 will be described in detail by reference to FIG. 2. The apparatus 1 includes a control device 13 which is essentially constituted by a microcomputer including a central processing unit (CPU) 2, a read only memory (ROM) 3, and a random access memory (RAM) 4. The control device 13 controls various operations of the present apparatus 1. A control program represented by the flow chart of FIG. 4 is pre-stored in the ROM 3. The apparatus 1 additionally includes a flash-memory device (FMD) 5 and an input and output (I/O) interface 6 each of which is connected via bus 14 to the control device 13. The FMD 5 holds the flash-memory card 10 as an external memory. The flash-memory card 10 can be removed from the FMD 5 of the apparatus 1, so that the card 10 may be inserted into the data reading device 24 of the sewing machine 15 of FIG. 8.

As shown in FIG. 1, the present apparatus 1 has, on the top thereof, a liquid crystal display (LCD) 7 having a screen 7*a* for providing a representation of the original image A taken by an image scanner 4 from the original sheet B. The LCD 7 is controlled by a display control device (LCDC) 8 connected to the control device 13. A display-data memory such as a video RAM 9 is connected to the LCDC 8 and the control device 13. Additionally, the apparatus 1 has two keys 11 (11*a*, 11*b*) which are manually operable by the user for inputting his or her "YES" and "NO" answers, respectively, to each of various questions displayed on the screen 7*a* of the LCD 7. The keys 11*a*, 11*b* are connected via the I/O interface 6 to the control device 13.

The image scanner 12 picks up the original image A from the original sheet B. The image scanner 12 is connected to the control device 13 via the I/O interface 6. In the present embodiment, the image scanner 12 is a hand-operable scanner which reads, from the original sheet B, the achromatic original image A provided in white and black colors only. With the upper portion of the scanner 12 being held by the palm of the user, the lower portion (i.e., reading head) of the scanner 12 is rolled over the original sheet B. With a button (not shown) of the scanner 12 being pushed by a finger of the user, the scanner 12 is moved slowly in one direction over the original image A. Thus, the original image A is obtained as raster-type digital image data or bit-map data containing sets of picture-element data corresponding to a number of picture elements of the original image A. Each set of picture-element data is a set of one-bit data representing a value of "0" or "1" defining the white or black color of a corresponding picture element. The image scanner 12 serves as an image reader which reads the original image A from the original sheet B and produces image data defining the original image A. The thus obtained image data are temporarily stored in the RAM 4.

According to the software program pre-stored in the ROM 3 and represented by the flow chart of FIG. 4, the present apparatus 1 functions as an image-data producing apparatus which includes the image scanner 12 for reading the original image A from the original sheet B and which automatically produces image data defining the original image A so that the thus produced image data are used to process embroidery data to form an embroidery corresponding to the original image A. In the case where the apparatus 1 is operated to process embroidery data to form a multiple-color embroidery corresponding to the original image A, the apparatus 1 identifies or distinguishes first to fourth processed region or regions A1; A2; A3; A4, A5 from one another among the five regions A1 to A5 of the original image A, and automatically produces four sets of embroidery data for the first to fourth processed region or regions, respectively.

As described in detail later, the step of producing the image data defining the original image A, is carried out in the following substeps: the first substep at which the image scanner 12 is used to read the outline of each region A1 to A5 from the original sheet B having the outline of each region A1 to A5, so as to produce the outline data defining the outline of each region A1 to A5; the second substep at which user's first processing of the original image A is carried out by forming, using an image-forming material such as a black ink, a readable image or images in the inside area(s) of one or more first regions selected by the user from the regions A1 to A5 of the original image A, so as to read, using the image scanner 12, the thus obtained first processed original image and produce first processed-image data defining the first processed original image; the third substep at which user's second processing of the original image A is effected by forming a readable image or images in the inside area(s) of one or more second regions selected by the user from the regions A1 to A5 of the original image A, so as to read, using the image scanner 12, the thus obtained second processed original image and produce second processed-image data defining the second processed original image; and the fourth substep at which the first region(s) is/are identified based on a difference between the first processed-image data and the outline data, so as to produce first region data defining the first region(s), and the second region(s) is/are identified or distinguished from the outlines D1 to D5 and the first region(s), based on a difference between the second processed-image data and the first processed-image data, so as to produce second region data defining the second region(s). Thus, the image data include the first and second region data defining the first and second regions distinguished from each other and from the other regions. The first region(s) is/are selected by the user from the regions A1 to A5, so as to embroider with a first needle thread having a first color, whereas the second region(s) is/are selected by the user from the regions A1 to A5, so as to embroider with a second needle thread having a second color different from the first color. The third and fourth substeps may be repeated to produce third region data defining one or more third regions selected by the user from the regions A1 to A5. In the latter case, the image data include the first, second, and third region data defining the first, second, and third regions distinguished from one another. The third region(s) is/are selected by the user from the regions A1 to A5, so as to embroider with a third needle thread having a third color different from the first and second colors. In the present embodiment, in addition to the region A as the first region(s), the region A2 as the second region(s), and the region A3 as the third region(s), the two regions A4 and A5 are selected as the fourth region(s) by the user from the regions A1 to A5, so as to embroider with a fourth needle thread having a fourth color different from the first to third colors. In the present embodiment, the RAM 4 of the control device 13 functions as a memory for storing the outline data and a memory for storing each of the first to fourth sets of processed-image data, and the control device 13 as a whole functions as means for identifying each of the first to fourth processed region or regions A1; A2; A3; A4, A5.

In the present embodiment, in the step of identifying one or more processed regions, the control device 13 judges whether each region is colored in with the black ink of the pen, by identifying whether a percentage of the area (i.e., number of picture elements) of the colored-in portion of each region to the total area of the same is greater than a threshold value. Different threshold values are employed for large, medium, and small regions, respectively. For example, for the large regions, 50% is used as the threshold value; for the medium regions, 75% is used; and for the small regions, 90% is used.

Next, there will be described the operation of the embroidery data processing apparatus 1 constructed as described above, by reference to the flow chart of FIG. 4 as well as FIG. 3 and FIGS. 6(A), 6(B), 6(C), 6(D). The following description relates to the operation of the apparatus 1 for processing embroidery data for, e.g., the original image A shown in FIG. 5.

Figure 6A:
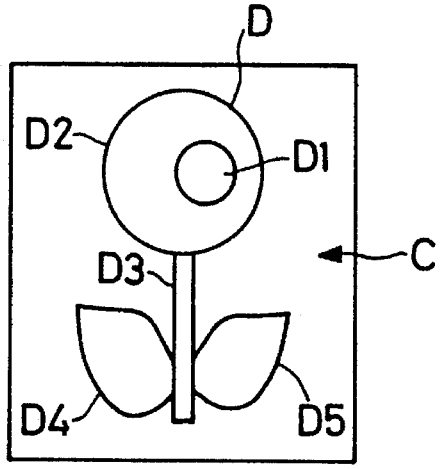
FIG. 6(A) is a view of an initial original image, C, which is read by the image scanner to produce outline-defining data.

Before starting the operation of the apparatus 1, the user prepares the original sheet B having an initial original image, C, consisting of outlines and boundary lines of the original image A, as shown in FIG. 6(A). The initial original image C is obtained by drawing, using a black-ink pen, respective outlines D1, D2, D3, D4, and D5, of the five outline-bounded regions A1 to A5, on the white base sheet B. The outlines D1 to D5 include boundary lines at which two regions (regions D1 and D2; D2 and D3; D3 and D4; and D3 and D5) are contiguous with each other. The black ink or black color coming out of the pen being used is readable or detectable by the achromatic-image scanner 12.

More specifically described, the initial original image C includes the outline D1 of the region A1 as the center of the flower of the plant; the two outlines D1, D2 of the region A2 as the petal of the flower; the outline D3 of the region A3 as the stem of the plant; the outline D4 of the region A4 as the left-hand leaf of the plant; and the outline D5 of the region A5 as the right-hand leaf of the plant. The outline D1 is not only the outline of the region A1 but also one of the two outlines of the region A2, therefore the outline D1 is the boundary line of the two regions A1 and A2.

Upon application of electric power to the present apparatus 1, the CPU 2 of the control device 13 accesses the embroidery-data processing program pre-stored in the ROM 3 and represented by the flow chart of FIG. 4. First, at Step S1 of FIG. 4, the CPU 2 operates for controlling the LCD 7 to display, on the display screen 7*a*, a message requesting the user to start reading the initial original image C from the original sheet B, e.g., "START READING INITIAL ORIGINAL IMAGE". In response to this message, the user starts the image scanner 12 in the above-described manner to read the initial original image C from the original sheet B that has been prepared in advance. Before this operation is started, negative judgments are made at Step S1, so that the CPU 2 repeats Step S1. Meanwhile, if the image-reading operation is started, a positive judgment is made at Step S1, so that the control of the CPU 2 proceeds with Step S2 to start reading the initial original image C from the original sheet B, and start producing outline data representing the outlines D1 to D5 of the initial image C. The thus produced outline data include bit-matrix or bit-map data representing the white or black color of each of the picture elements of the initial image C taken from the original sheet B. Step S2 is followed by Step S3 to provide, on the LCD 7 (i.e., screen 7*a*), a visual representation of the read initial image C, based on the produced outline data or bit-map data. The displaying of the initial image C on the LCD 7 is carried out concurrently with the reading of the same C by the image scanner 12 from the original sheet B. At the following Step S4, the CPU 2 judges whether the reading of the initial image C, i.e., the production of the outline data has been completed. Before the image scanner 12 has been moved by a prescribed distance, negative judgments are made at Step S4, so that the control of the CPU 2 goes back to Step S2. On the other hand, when the image scanner 12 has been moved by the prescribed distance, a positive judgment is made at Step S4. At this time, the entire initial image C should have already been displayed on the LCD 7. Hence, at the following Step S5, the CPU 2 operates for controlling the LCD 7 to provide, together with the initial image C, a message requesting the user to judge whether the initial image C has been read correctly. If the user judges that the initial image C has been read correctly, he or she pushes the "YES" key 11*a*, so that the control of the CPU 2 goes to Step S6. Thus, the production of the outline data is ended. On the other hand, if the user does not judge that the initial image C has been read correctly, he or she pushes the "NO" key 11*b*, so that the control of the CPU 2 goes back to Step S1.

At Step S6, the CPU 2 operates for controlling the LCD 7 to display a message requesting the user to decide whether or not to select the outline-sewing-data processing mode, e.g., message "OUTLINE SEWING IS NEEDED ?". At this step, the user can select, or not select, the operation mode in which outline sewing data to form stitches along the outlines D1 to D5 of the original image A are processed based on the outline data. When the user selects this mode, he or she pushes the "YES" key 11*a*. On the other hand, when not, the user pushes the "NO" key 11*b*. In the former case, a positive judgment is made at Step S6, and the control of the CPU 2 goes to Step S7 to produce outline sewing data based on the outline data obtained at Step S2. The outline data are so modified as to define the center line of each "thick" outline D1 to D5 (having a width corresponding to a plurality of picture elements), according to a known bit-map data processing technique. Otherwise, the outline data may be so modified as to define an outer or inner peripheral line of each "thick" outline D1 to D5, according to a known technique. Based on the thus modified outline data, the control device 13 produces sets of vector data defining short straight segments connected to one another at points located on each outline D1 to D5, according to another known bit-map data processing technique. The short straight segments cooperate with one another to define each outline D1 to D5. The thus produced outline sewing data may be sewing data to form zigzag stitches along the outlines D1 to D5 of the regions A1 to A5. The outline sewing data may include sets of stitch-position data representing stitch positions located on both sides of each outline D1 to D5, so that the zigzag stitches are formed along each outline D1 to D5 as a reference line. Other than zigzag-stitch sewing, single-, double-, or triple-stitch sewing, or E-stitch sewing may be employed to embroider each outline D1 to D5. The produced outline sewing data are stored or recorded in the flash-memory card 10 being inserted in the FMD 5. Step S6 may be so modified as to enable the user to choose whether or not to produce outline sewing data, with respect to the outline(s) of each of the regions A1 to A5. In this modified manner, outline sewing data are produced for a boundary line such as the outline D1, if the user chooses to sew the outline(a) of at least one of the two regions contiguous with each other at that boundary line. On the other hand, if the user pushes the "NO" key 11*b* and a negative judgment is made at Step S6, the control of the CPU 2 skips Step S7 and goes to Step S8. In the present embodiment, it is assumed that no outline sewing data is produced.

At Step S8, the CPU 2 operates for identifying the inside area of each of the five outline-bounded regions A1 to A5 of the original image A of FIG. 5, based on the outline data representing the outlines D1 to D5 of FIG. 6(A), and producing area data (bit-map data) representing the inside area of each region A1 to A5, according to known bit-map data processing techniques. Only with the thus produced area data, however, the CPU 2 or the control device 13 cannot automatically judge whether the inside area of a region (e.g., A1) completely contained inside the outline of another region (e.g., A2) is to be embroidered, or, cannot judge, if the former region is to be embroidered, whether the former region is to be embroidered with the same needle thread, i.e., in the same color, as that for the latter region. Additionally, the CPU 2 cannot judge whether the respective inside areas of a plurality of regions are to be embroidered with a common thread, i.e. in a common color, or with different threads having different colors. For example, the CPU 2 cannot judge whether the inside area of the region A1 completely contained inside the outline D2 of the region A2 is an area to be embroidered, or an area not to be embroidered and just to define the inner periphery of the region A2. It goes without saying that the CPU 2 cannot know the user's intention assumed in the present embodiment that the regions A1, A2, A3 are embroidered in different colors, respectively, and the regions A4, A5 are embroidered in a common color which is different from the three colors for the three regions A1 to A3.

Hence, at Step S9 and the following steps, the present apparatus 1 produces two or more sets of processed-image data (described later), and distinguishes one or more first regions each to be embroidered in a first color, from one or more second regions to be embroidered in a second color different from the first color, and, if appropriate, from other regions to be embroidered in other colors different from the first and second colors.

Figure 6B:
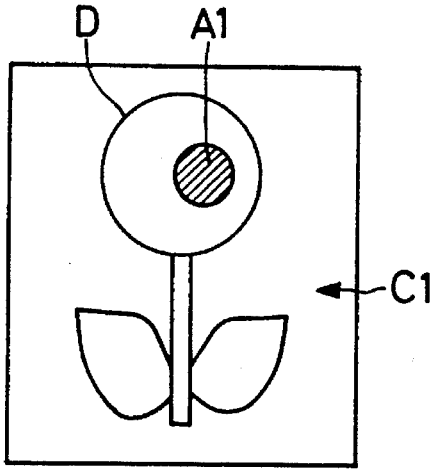
FIG. 6(B) is a view of a first processed original image, C1, which is read by the image scanner to produce first processed-image data.

At Step S9, the CPU 2 operates for controlling the LCD 7 to display a message requesting the user to color in one or more first regions to be embroidered with a needle thread having a first color, i.e., message "COLOR IN REGION(S) TO BE SEWN IN FIRST COLOR". In response to this message, the user colors in one or more regions selected from the regions A1 to A5, using a black-ink pen, for example. Other sorts of image-forming materials may be used. For example, a color tape may be employed in place of a color-ink pen. This coloring-in or blacking-out need not be carried out in a complete manner, that is, only an almost or major portion of the selected region or each of the selected regions needs to be colored in or blacked out. In addition, the user is allowed to erroneously color in a small portion of another region or other regions adjacent to the selected region or regions but not to be selected, for the reasons described later. When the user colors in the inside area of the outline D1 of the region A1, the initial original image C is initially processed into a first processed original image, C1, as shown in FIG. 6(B). Step S9 is followed by Step S10 to set a counter, N, to N=1. The state of N=1 indicates that the first processed original image C1 including the processed region A1 as the first region(s) to be embroidered in the first color, is read in the current control cycle of Steps S11 to S15.

Figure 6C:
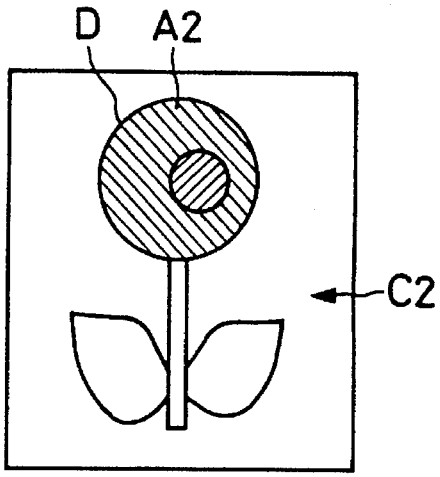
FIG. 6(C) is a view of a second processed original image, C2, which is read by the image scanner to produce second processed-image data.
Figure 6D:
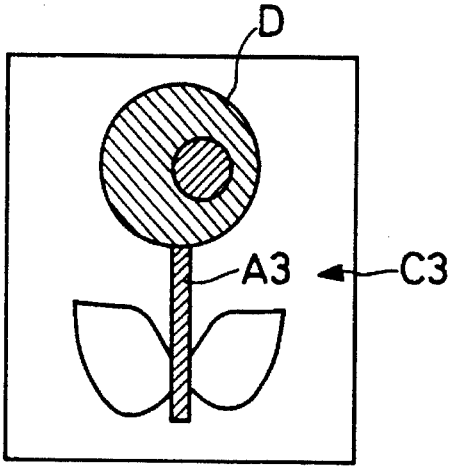
FIG. 6(D) is a view of a third processed original image, C3, which is read by the image scanner to produce third processed-image data.
Figure 6E:
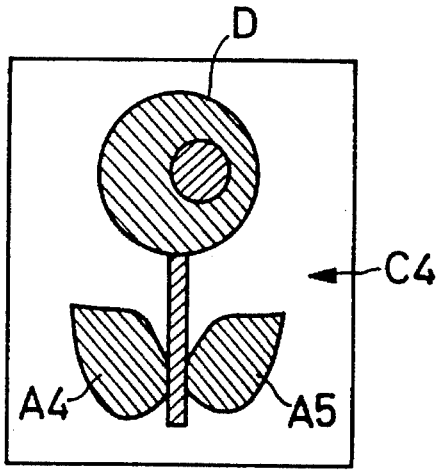
FIG. 6(E) is a view of a fourth processed original "image, C4, which is read by the image scanner to produce fourth processed-image data.

At Steps S11 to S15, the present apparatus 1 operates for producing an N-st set of processed-image data from the first processed original C1 (N=1) or each of second to fourth processed originals C2, C3, C4 (N=2, 3, 4) shown in FIGS. 6(C), 6(D), 6(E). Steps S11 to S15 are carried out in substantially the same manner as Steps S1 to S5. In short, the CPU 2 operates for controlling the LCD 7 to display a message "START READING N-ST PROCESSED ORIGINAL IMAGE". In response to this message, the user operates the image scanner 12 to read the N-st processed original image (for the first time, the first processed original C1) and produce the N-st set of processed-image data based on the read N-st processed original image. The N-st processed-image data are bit-map data. The read N-st processed original image is displayed on the LCD 7 based on the N-st processed-image data. When the user judges on the screen 7*a* of the LCD 7 that the N-st processed original image has been read correctly, he or she pushes the "YES" key 11*a*, so that the control of the CPU 2 goes to Step S16.

Figure 3:
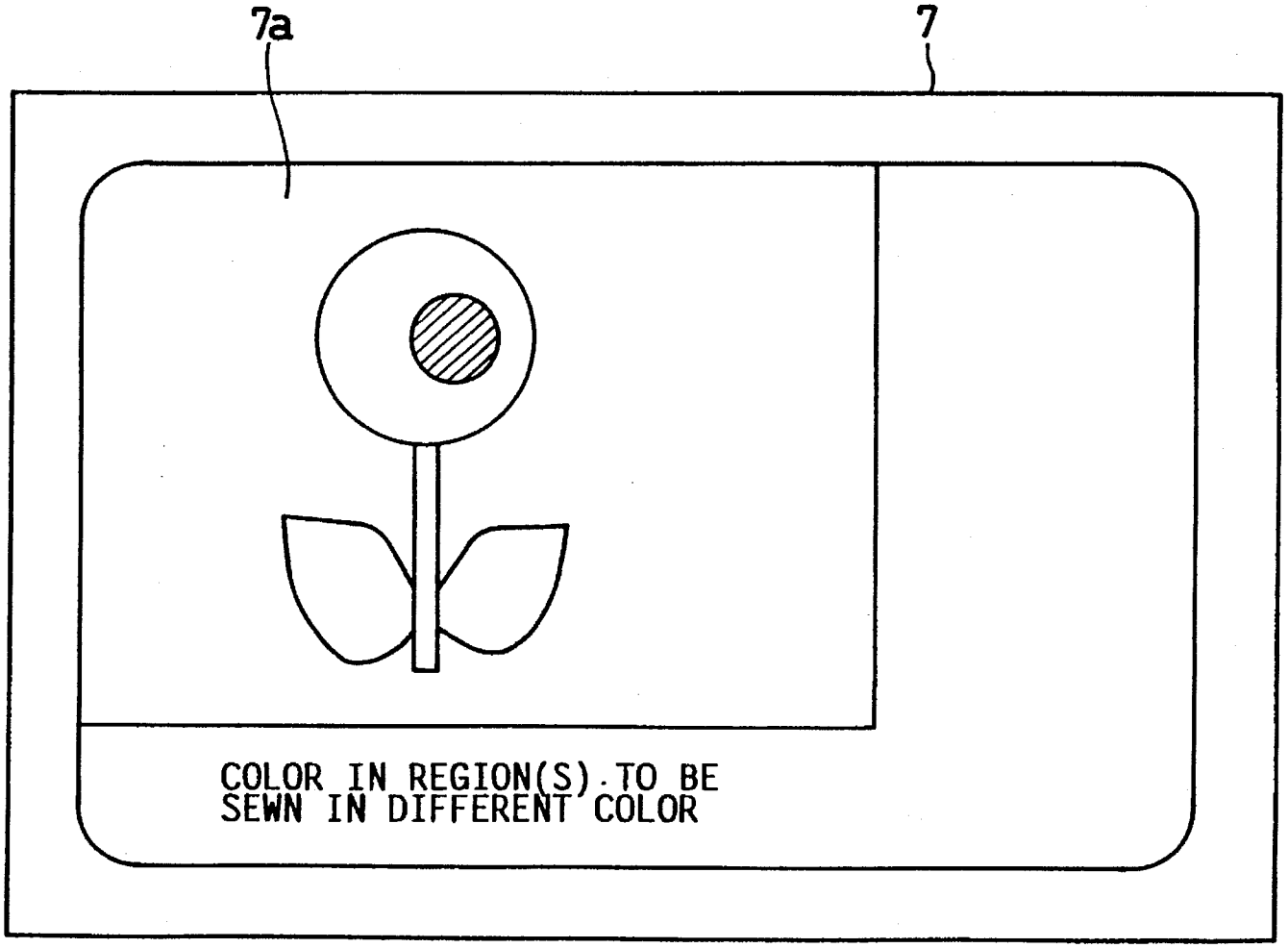
FIG. 3 is a view of an image and a message displayed on a screen of a liquid-crystal display of the apparatus of FIG. 1.

At Step S16, the CPU 2 operates for controlling the LCD 7 to display, on the screen 7*a*, a message requesting the user to color in region(s) to be embroidered in a different color, e.g., message "COLOR IN REGION(S) TO BE SEWN IN DIFFERENT COLOR", as shown in FIG. 3. This message is not deleted during the duration in which the following Steps S17 and S18 are carried out.

At Step S17, the CPU 2 identifies and distinguishes the N-st processed region(s) to be embroidered in the N-st color, from the other regions to be embroidered in the other colors.

Specifically described, at Step S17, the CPU 2 identifies which region(s) out of the regions A1 to A5 has/have been read as the N-st processed region(s), based on the area data obtained at Step S8 and the N-st set of processed-image data obtained at Step S12, and produces an N-st set of region data defining the N-st processed region(s) based on the difference between the N-st set of processed-image data obtained at Step S12 in the current control loop of Steps S11 to S20 and an (N-1)-st set of processed-image data obtained at Step S12 in the preceding control loop of the same steps. However, the CPU 2 produces a first set of region data defining the first processed region(s), based on the difference between the area data obtained at Step S8 and the first set of processed-image data obtained at Step S12. Regarding the original image A, the present apparatus 1 produces the first set of region data defining the region A1, based on the first set of processed-image data.

The CPU 2 judges whether each region A1 to A5 is colored in, or covered, with the black ink of the pen, by identifying whether a percentage of the area (i.e., number of picture elements) of the colored-in portion of each region to the total area of the same is greater than a threshold value. Different threshold values are employed for large, medium, and small regions, respectively. For example, for the large regions, 50% is used as the threshold value; for the medium regions, 75% is used; and for the small regions, 90% is used. Therefore, even though the coloring-in or blacking-out may not be carried out in a complete fashion, the control device 13 or CPU 2 reliably identifies the region or regions colored in by the user with the black pen.

Step S17 is followed by Step S18 to produce area sewing data to form stitches filling the inside area(s) of the N-st processed region(s), based on the N-st set of region data obtained at Step S17. In the present embodiment, an N-set of region data include region-area data defining the inside area(s) of the N-st region(s). Otherwise, region-outline data defining the outline(s) of the N-st region(s) may be produced in place of the region-area data. The region-outline data may be produced based on the region-area data, and vice versa. There are known various techniques for producing, directly from region-area data as bit-map data, sets of stitch-position data representing stitch positions where the needle 22 of the sewing machine 15 penetrates a work sheet, and there are also known various techniques for producing, based on region-outline data, sets of stitch-position data representing stitch positions. Therefore, detailed description of the manner of production of the area sewing data is omitted. The thus produced area sewing data to be used to embroider the N-st region(s) in the N-st color, are recorded together with the outline sewing data obtained at Step S7, in the flash-memory card 10.

During the time duration in which the apparatus 1 carries out Steps S17 and S18, the user can further process the previously processed original image from which the N-st processed region(s) has/have been read, i.e., color in one or more (N+1)-st region(s) to be embroidered in the (N+1)-st color, using the black pen, in response to the message provided on the LCD 7 at Step S16. Thus, for example, the first processed original image C1 is further processed into the second processed original image C2 shown in FIG. 6(C), by coloring in the region A2 as the second processed region(s) to be embroidered in the second color.

Step S18 is followed by Step S19 at which the CPU 2 operates for controlling the LCD 7 to display a message asking the user whether to end the current embroidery-data processing operation, e.g., message "THE CURRENT OPERATION IS ENDED ?" The user pushes the "YES" key 11*a* or the "NO" key 11*b*. In the case where the user ends the current operation by pushing the "YES" key 11*a*, the current control cycle in accordance with the flow chart of FIG. 4 is finished. On the other hand, in the case where the user continues to read another or other processed original image(s) and produce another or other set(s) of area sewing data, he or she pushes the "NO" key 11*b*, so that a negative judgment is made at Step S19 and so that the control of the CPU 2 goes to Step S20 to add one to the counter N, and subsequently goes back to Step S11 and the following steps.

The second processed original image C2 has the two regions A1 and A2 colored in with the black ink. Therefore, the apparatus 1 produces, at Step S12, a second set of processed-image data defining the regions A1 and A2. At Step S17, however, the control device 13 or CPU 2 distinguishes the second processed region A2 newly colored in and to be embroidered in the second color, from the first processed region A1 previously colored in and to be embroidered in the first color, based on the difference between the second set of processed-image data defining the regions A1 and A2 and the first set of processed-image data defining the region A1. In the same manner, the third and fourth processed original images C3, C4 shown in FIGS. 6(D) and 6(E) are prepared by the user and read by the image scanner 12 so as to produce a third and a fourth set of processed-image data, identify the third processed region A3 and the fourth processed regions A4 and A5, and produce a third and a fourth set of area sewing data. Regarding the fourth processed original image C4, the two regions A4 and A5 are colored in at the same time, so that the apparatus 1 distinguishes, from the first to third processed regions, the fourth processed regions A4, A5 to be embroidered in the fourth color.

The flash-memory card 10 storing the thus produced embroidery data including the first to fourth sets of area sewing data, is removed from the FMD 5 of the apparatus 1, and is inserted into the data reading device 24 of the embroidery sewing machine 15 of FIG. 10. According to the embroidery data stored in the flash-memory card 10, the sewing machine 15 automatically forms, on the work sheet held by the frame 18, an embroidery corresponding to the original image A. In the embroidery-forming operation, first, the sewing machine 15 forms stitches to fill the inside area of the region A1, with a thread having a first color selected by the user. Following this sewing operation, the sewing machine 15 stops the needle 22 and displays, on the screen 26, a message requesting the user to change needle threads. In response to this message, the user changes the current thread to a different thread having a second color different from the first color. Subsequently, the user re-starts the sewing machine 15 to form stitches filling the region A2 with the new thread having the second color. Since the fourth processed original image C4 is prepared by simultaneously coloring in the regions A4 and A5 to embroider with a common thread, the two regions A4, A5 are continuously sewn without changing threads.

It emerges from the foregoing description that, in the present embodiment, the user first prepares the original B having the initial original image C consisting of the outlines and boundary lines D of the original image A, i.e., outlines D1 to D5 of the regions A1 to A5, and then stepwise processes the initial original image C by coloring in the first to fourth region(s) A1, A2, A3, and A4, A5 and thereby providing the first to fourth processed original images C1 to C4. Only with the original images C, C1 to C4 prepared and processed on the single sheet B, the image scanner 12 can stepwise read each of the first to fourth processed original images and produce the first to fourth sets of processed-image data necessary to process embroider data to form an embroidery in multiple colors. Thus, in the present embodiment, the single sheet B suffices in contrast to the conventional method in which the user is required to prepare the four sheets B1 to B4 shown in FIGS. 9(A) to 9(D). Thus, the amount of working of the user is much reduced as compared with the conventional method.

Moreover, the present apparatus 1 employs the achromatic image scanner 12 that costs lower than a chromatic image scanner. Because of the employment of the achromatic image scanner 12, the hardware and software configurations of the apparatus 1 are much simplified.

Furthermore, in the present embodiment, the control device 13 or CPU 2 identifies whether each region A1 to A5 has been colored in with the black pen, by judging whether the percentage of the area of the colored-in portion of each region to the total area of the same is greater than a threshold value. Thus, even if the coloring-in or blacking-out of the inside area of each region may not be carried out in a complete or strict manner, the CPU 2 reliably identifies which region or regions has/have been colored in by the user with the black pen. Therefore, the user can perform the coloring-in of a region or regions, with ease and with efficiency. Since different threshold values are used for different regions having different areas (i.e., large, medium, and small regions), respectively, the user is just required to color in a small area or portion of a region to be processed, even if the region may be large.

Moreover, the present apparatus 1 can process outline sewing data to form stitches along each outline D1 to D5 of the original image A, at Steps S6 and S7. Thus, the apparatus 1 can produce various batches of embroidery data for a single original image, thereby providing user's desirable embroidery data. In addition, since the apparatus 1 provides various helpful messages on the LCD 7, the user can easily operate the apparatus 1 for processing embroidery data for user's desirable original image.

Figure 7:
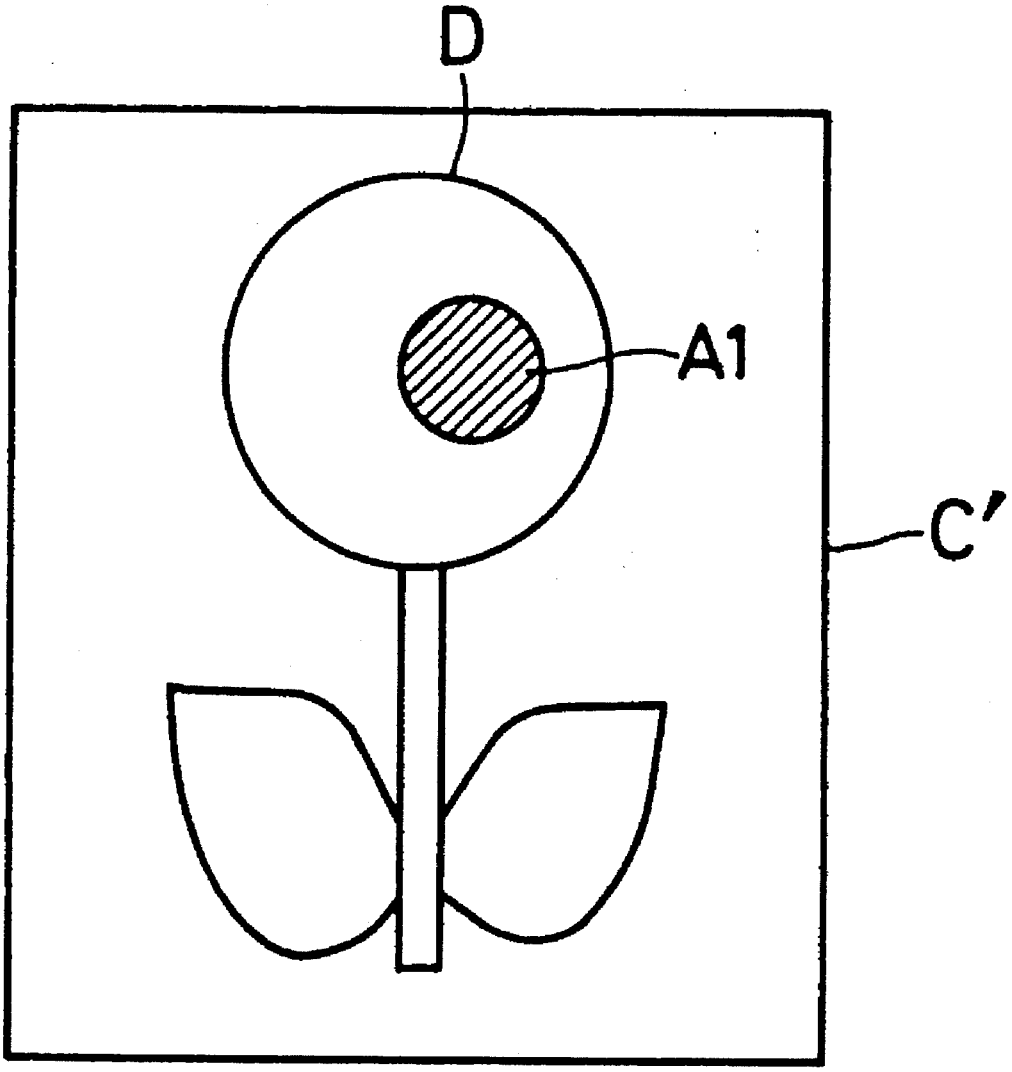
FIG. 7 is a view of another initial original image, C', which is read by an image scanner of another embroidery data processing apparatus as a second embodiment of the invention.

Next, there will be described a second embodiment of the present invention by reference to FIG. 7. In the second embodiment, a user prepares an initial original image, C', shown in FIG. 7. The initial original image C' is different from the initial original image C shown in FIG. 6(A), in that the former image C' includes, in addition to the outlines D (D1 to D5) drawn with a black-ink pen, the outline-bounded region A1 processed by being colored in with the black pen. In the case where the user chooses to process outline sewing data to form stitches along the outlines D, he or she can prepare the initial image C' and select the outline-sewing-data processing mode at Step S6 of FIG. 4. In this case, at Step S7, the apparatus 1 produces not only outline sewing data to form zigzag stitches along the outlines D (D1 to D5), but also area sewing data to form stitches filling the inside area of the region A1. The apparatus 1 automatically distinguishes the wider or thicker region A1 from the narrower or thinner outlines D, according to a known bit-map data processing technique.

Thereafter, regarding the remaining regions A2; A3; A4 and A5, the same steps as those described in connection with the second to fourth processed original images C2 to C4 are carried out. In the second embodiment, the number of reading of the initial and processed original images C' and C2 to C4 (i.e., four times) is reduced one time as compared with the first embodiment wherein the initial and processed original images C and C1 to C4 (i.e., five times) are read by the image scanner 12.

While the present invention has been described in its preferred embodiments, the invention may otherwise be embodied.

For example, although in the illustrated embodiments outline sewing data are processed after outline data are produced from the outlines D of the initial original image C, and a set of area sewing data is processed each time an N-st processed region(s) to be embroidered in an N-st color is/are distinguished from the other regions, it is possible to carry out, after the outlines are read and all the processed regions are distinguished, the step of selecting the outline-sewing-data processing mode, the step of producing the outline sewing data, and the step of producing the sets of area sewing data. It is also possible to distinguish each of the first to fourth processed region(s) from the other processed regions after all the processed original images C1 to C4 have been read and all the sets of processed-image data have been produced. In the last case, the CPU 2 temporarily stores the outline data and the sets of processed-image data in different memory areas of the RAM 3, respectively.

While in the illustrated embodiments three threshold values are employed for large, medium, and small regions, respectively, for judging whether each of the regions A1 to A5 is colored in with the black pen, by identifying the percentage of the area of the colored-in portion of each region to the total area of the same is greater than a corresponding threshold value, it is possible to use a single, constant threshold value or use four or more threshold values. Additionally, in place of the percentage of the area of the colored-in portion of each region to the total area of the same, it is possible to compare the "raw" number of the picture elements of the colored-in portion of each region A1 to A5, with a threshold value. In the latter case, if a very small value is used as the threshold, a user can complete the coloring-in of region(s), by just writing a small black circle or mark in the inside area of each region. A small, cut black tape may be used to add to the selected region(s) and thereby form an achromatic image readable by the image scanner 12. This manner of coloring-in of regions is more advantageous in stepwise reading an original image including a greater number of outline-bounded regions.

The principle of the present invention is also applicable to the processing of embroidery data to control a multiple-needle embroidery sewing machine having a plurality of sewing needles. The sewing machine automatically selects and uses one of color-different threads conveyed by the sewing needles, according to the embroidery data. The embroidery-data processing apparatus 1 may be provided by a wide-use personal computer. The hand-operable image scanner 12 may be replaced by a wide-use installed-type image reader.

Furthermore, although in the illustrated embodiments the image scanner 12 is used as an integral part of the embroidery data processing apparatus 1, it is possible to provide an image data producing apparatus including an image reader, independent of an embroidery data processing apparatus. In the latter case, the image data produced by the image data producing apparatus may be stored in an external memory such as a floppy disk, and then the memory is inserted into a data reading device of the embroidery data processing apparatus, so that the image data defining an original image are used to process embroidery data to form an embroidery corresponding to the original image.

It is to be understood that the present invention may be embodied with other changes, improvements, and modifications that may occur to those skilled in the art without departing from the scope and spirit of the invention defined in the appended claims.

What is claimed is:

1. A method of producing image data defining an original image comprising at least one outline-bounded region having at least one outline and an inside area bounded by the outline, the method comprising the steps of:

detecting from an original having an initial original image comprising said outline of said at least one outline-bounded region, said initial original image with an image detector, so as to produce image data defining at least one of said outline of said region and said inside area of the region, initially processing said initial original image of said original by forming, with a material detectable by said image detector, at least one detectable image in the inside area of at least one current region out of said at least one outline-bounded region thereby defining at least one initially processed regions, detecting, with said image detector, the initially processed original image so as to produce initially processed image data defining said initially processed original image, and identifying the at least one initially processed region based on a difference of said initial image data and said initially processed image data.

2. A method according to claim 1, further comprising the step of producing initially processed region-defining data defining said initially processed region, said image data comprising said initially processed region-defining data.

3. A method according to claim 1, wherein the step of detecting said initial original image comprises detecting, from said original having said initial original image comprising the outline of each of a plurality of outline-bounded regions, said initial original image so as to produce said initial image data comprising at least one of (a) outline-defining data defining said outline of said each region and (b) area-defining data defining the inside area of said each region, and wherein the method further comprises at least one repetition of the steps of:

further processing the previously processed original image of said original by forming at least one detecting image in the inside area of at least one current region out of at least one remaining outline-bounded region which has not been processed yet, reading, by said image detector, the further processed original image so as to produce further processed image data defining said further processed original image, identifying the further processed region based on a difference of said further processed image data and said initially processed image data, and producing further processed region-defining data defining said further processed region, said image data comprising said further processed region-defining data.

4. A method according to claim 2, further comprising the step of operating an embroidery data processing apparatus to process, based on said initially processed region-defining data, embroidery data to control a sewing machine to form, on a work sheet, an embroidery corresponding to said initially processed region defined by the initially processed region-defining data.

5. A method according to claim 4, further comprising the step of utilizing said embroidery data to control the sewing machine to form said embroidery on the work sheet.

6. A method according to claim 5, wherein the step of utilizing said embroidery data comprises controlling a stitch-forming device of the sewing machine to form stitches according to said embroidery data and thereby produce said embroidery on the work sheet.

7. A method according to claim 5, wherein the step of utilizing said embroidery data comprises recording, in an external memory such as an EEPROM, said embroidery data to control the sewing machine to form said embroidery on the work sheet.

8. A method according to claim 1, wherein the step of identifying said initially processed region comprises judging that said inside area of the initially processed region is covered with said detectable image, when a ratio of an area of the detectable image to an area of the inside area of the initially processed region is greater than a reference value.

9. A method according to claim 8, wherein the step of judging comprises selecting, for each of a plurality of different regions having different areas, a corresponding one of a plurality of different reference values.

10. A method according to claim 3, wherein at least one of (a) the step of initially processing said initial original image and (b) the step of further processing said previously processed original image comprises processing at least one of said initial original image and said previously processed original image, by forming said detectable image in the inside area of each of a plurality of current regions out of a plurality of outline-bounded regions which have not been processed yet.

11. A method according to claim 1, wherein the step of detecting said initial original image comprises detecting said initial original image comprising the outline of each of a plurality of outline-bounded regions contiguous with each other, from said original on which said outline of said each region is prepared by a user, so as to produce said initial image data comprising outline-defining data defining said outline of said each region, said outline of said each region including a boundary line at which said regions are contiguous with each other.

12. A method according to claim 1, wherein the step of processing said initial original image comprises processing said initial original image by forming said detectable image with said detectable material selected from the group consisting of a color ink and a color tape.

13. An apparatus for producing image data defining an original image comprising at least one outline-bounded region having at least one outline and an inside area bounded by the outline, the apparatus comprising:

an image detector which detects, from an original having an initial original image comprising said outline of said at least one outline-bounded region, said initial original image so as to produce initial image data defining at least one of said outline of said region and said inside area of the region, a first memory which stores said initial image data;

said image,detector detecting an initially processed original image obtained by processing said initial original image of said original by forming, with a material detectable by said image detector, at least one detectable image in the inside area of at least one current region out of said at least one outline-bounded region thereby forming at least one initially processed region, so as to produce initially processed image data defining said initially processed original image;

a second memory which stores said initially processed image data; and identifying means for identifying the at least one initially processed region based on a difference of said initial image data stored in said first memory and said initially processed image data stored in said second memory.

14. An apparatus according to claim 13, further comprising producing means for producing initially processed region-defining data defining said initially processed region, said image data comprising said initially processed region-defining data.

15. An apparatus according to claim 13, wherein said image detector comprises:

means for detecting, from said original having said initial original image comprising the outline of each of a plurality of outline-bounded regions, said initial original image so as to produce said initial image data comprising at least one of (a) outline-defining data defining said outline of said each region and (b) area-defining data defining the inside area of said each region; and means for detecting a further processed original image obtained by further processing the previously processed original image of said original by forming at least one detectable image in the inside area of at least one current region out of at least one outline-bounded region which has not been processed, so as to produce further processed image data defining the further processed original image, wherein said identifying means identifies the further processed region based on a difference of said further processed image data and said initially processed image data.

16. An apparatus according to claim 14, further comprising an embroidery-data processing device which processes, based on said initially processed region-defining data, embroidery data to control a sewing machine to form, on a work sheet, an embroidery corresponding to said initially processed region defined by the initially processed region-defining data.

17. An apparatus according to claim 16, further comprising a utilizing device which utilizes said embroidery data to control the sewing machine to form said embroidery on the work sheet.

18. An apparatus according to claim 17, wherein said utilizing device comprises a stitch-forming device of the sewing machine which forms stitches according to said embroidery data and thereby produce said embroidery on the work sheet.

19. An apparatus according to claim 17, wherein said utilizing device comprising a recording device which records, in an external memory, said embroidery data to control the sewing machine to form said embroidery on the work sheet.

20. An apparatus according to claim 13, wherein said identifying means comprises means for judging that said inside area of said initially processed region is covered with said detectable image, when a ratio of an area of the detectable image to an area of the inside area of the initially processed region is greater than a reference value.

21. An apparatus according to claim 13, wherein said image detector comprises means for detecting said initial original image comprising the outline of each of a plurality of outline-bounded regions contiguous with each other, from said original on which said outline of said each region is prepared by a user, so as to produce said initial image data comprising outline-defining data defining said outline of said each region, said outline of said each region including a boundary line at which said regions are contiguous with each other.

22. An apparatus according to claim 13, wherein said image detector comprises means for detecting said initially processed original image obtained by processing said initial original image by forming said detector image with said detectable material selected from the group consisting of a color ink and a color tape.

23. An apparatus according to claim 13, wherein said image detector comprises means for producing said initial image data and said initially processed image data each of which comprises a number of sets of binary data each set of which represents one of two colors one of which corresponds to a background color of said original and the other of which corresponds to a color of said outline of said outline-bounded region and said detectable image.

24. A method according to claim 1, wherein said image detector comprises an image scanner which scans said initial original image and subsequently scans said initially processed original image, at least one of said original and said image scanner being movable relative to each other.

25. An apparatus according to claim 13, wherein said image detector comprises an image scanner which scans said initial original image and subsequently scans said initially processed original image, at least one of said original and said image scanner being movable relative to each other.

* * * * *